US008291922B2

(12) United States Patent
Han et al.

(10) Patent No.: US 8,291,922 B2
(45) Date of Patent: Oct. 23, 2012

(54) DISH WASHING MACHINE

(75) Inventors: Jung Youp Han, Seoul (KR); Yong Jin Choi, Seoul (KR); Joon Ho Pyo, Seoul (KR); Young Hwan Park, Seoul (KR); Seong Ho Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 313 days.

(21) Appl. No.: 12/528,330

(22) PCT Filed: Jul. 30, 2008

(86) PCT No.: PCT/KR2008/004438

§ 371 (c)(1),
(2), (4) Date: Aug. 24, 2009

(87) PCT Pub. No.: WO2009/028803

PCT Pub. Date: Mar. 5, 2009

(65) Prior Publication Data

US 2010/0095989 A1 Apr. 22, 2010

(30) Foreign Application Priority Data

Aug. 31, 2007 (KR) ..... 10-2007-0088571

(51) Int. Cl.
*B08B 3/02* (2006.01)

(52) U.S. Cl. ..... 134/105; 134/108

(58) Field of Classification Search ..... 134/105, 134/108, 56 D

See application file for complete search history.

(56) References Cited

U.S. PATENT DOCUMENTS

| | | | | |
|---|---|---|---|---|
| 3,068,877 | A | 12/1962 | Jacobs | |
| 4,366,005 | A | 12/1982 | Oguri et al. | |
| 5,076,306 | A * | 12/1991 | Suzuki et al. | 134/95.2 |
| 5,337,500 | A | 8/1994 | Enokizono | |
| 7,290,981 | B2 * | 11/2007 | Guzorek | 415/151 |
| 7,909,939 | B2 * | 3/2011 | Brewer et al. | 134/56 D |
| 2004/0149321 | A1 | 8/2004 | McKee | |
| 2007/0102025 | A1 | 5/2007 | Ahn et al. | |
| 2009/0038661 | A1 * | 2/2009 | Hildenbrand | 134/56 D |

FOREIGN PATENT DOCUMENTS

| | | | |
|---|---|---|---|
| CA | 2 607 829 | A1 | 11/2006 |
| DE | 40 34 380 | A1 | 4/1992 |
| DE | 10 2004 048 091 | A1 | 4/2006 |

(Continued)

OTHER PUBLICATIONS

WIPO WO 2005/034716 Apr. 2005.*

(Continued)

*Primary Examiner* — Frankie L Stinson

(74) *Attorney, Agent, or Firm* — Birch, Stewart, Kolasch & Birch, LLP

(57) ABSTRACT

The present invention relates to a dish washing machine, and more particularly to a dish washing machine having a structure in which a bottom surface of the dish washing machine is not wet with water. The dish washing machine includes a washing chamber (150) for washing dishes, a fan (90) for discharging air from the washing chamber (150), a housing for a space to install the fan (90), an exhaust duct (92) for guiding the air from the housing (94) to an outside of the dish washing machine, and a passage for draining water to an outside of the housing (94) whenever the water is present in the housing (94).

5 Claims, 5 Drawing Sheets

FOREIGN PATENT DOCUMENTS

| | | | | |
|---|---|---|---|---|
| DE | 10 2005 023 428 | A1 | | 11/2006 |
| DE | 10 2006 025 150 | A1 | | 12/2006 |
| EP | 0 593 876 | A1 | | 4/1994 |
| EP | 0 920 830 | A1 | | 6/1999 |
| EP | 1 055 389 | A2 | | 11/2000 |
| EP | 1 415 588 | A2 | | 5/2004 |
| EP | 1 284 627 | B1 | | 8/2004 |
| EP | 1 671 572 | A1 | | 6/2006 |
| EP | 1 738 677 | A2 | | 1/2007 |
| FR | 2 491 322 | | * | 4/1982 |
| FR | 2 646 501 | | * | 11/1990 |
| GB | 2 274 772 | A | | 8/1994 |
| JP | 54-071843 | | * | 6/1979 |
| JP | 2000-126107 | | * | 9/2000 |
| JP | 2002-253469 | | * | 9/2002 |
| JP | 2003-118358 | A | | 4/2003 |
| JP | 2007-037798 | | * | 2/2007 |
| JP | 2007-215882 | A | | 8/2007 |
| KR | 2001-0090159 | A | | 10/2001 |
| KR | 2002047870 | | * | 6/2002 |
| KR | 2005014516 | | * | 2/2005 |
| KR | 2005024545 | | * | 3/2005 |
| KR | 2005054698 | | * | 6/2005 |
| KR | 2005014515 | | * | 2/2007 |
| WO | WO 2006/006126 | A1 | | 1/2006 |
| WO | WO 2006/127478 | A1 | | 11/2006 |

OTHER PUBLICATIONS

European Patent Office 1 097 669 May 2001.*

* cited by examiner

[Fig. 1]
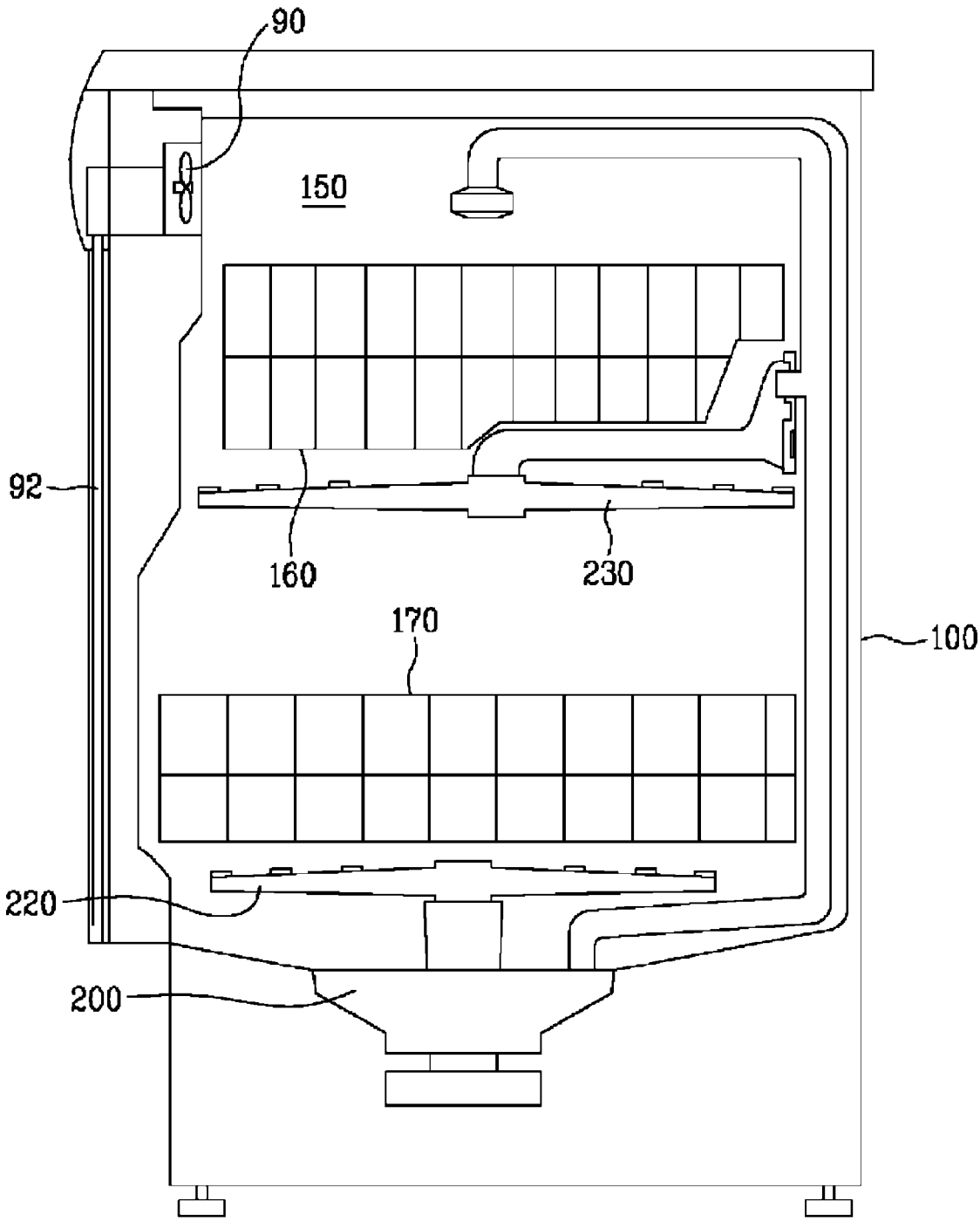

[Fig. 2]
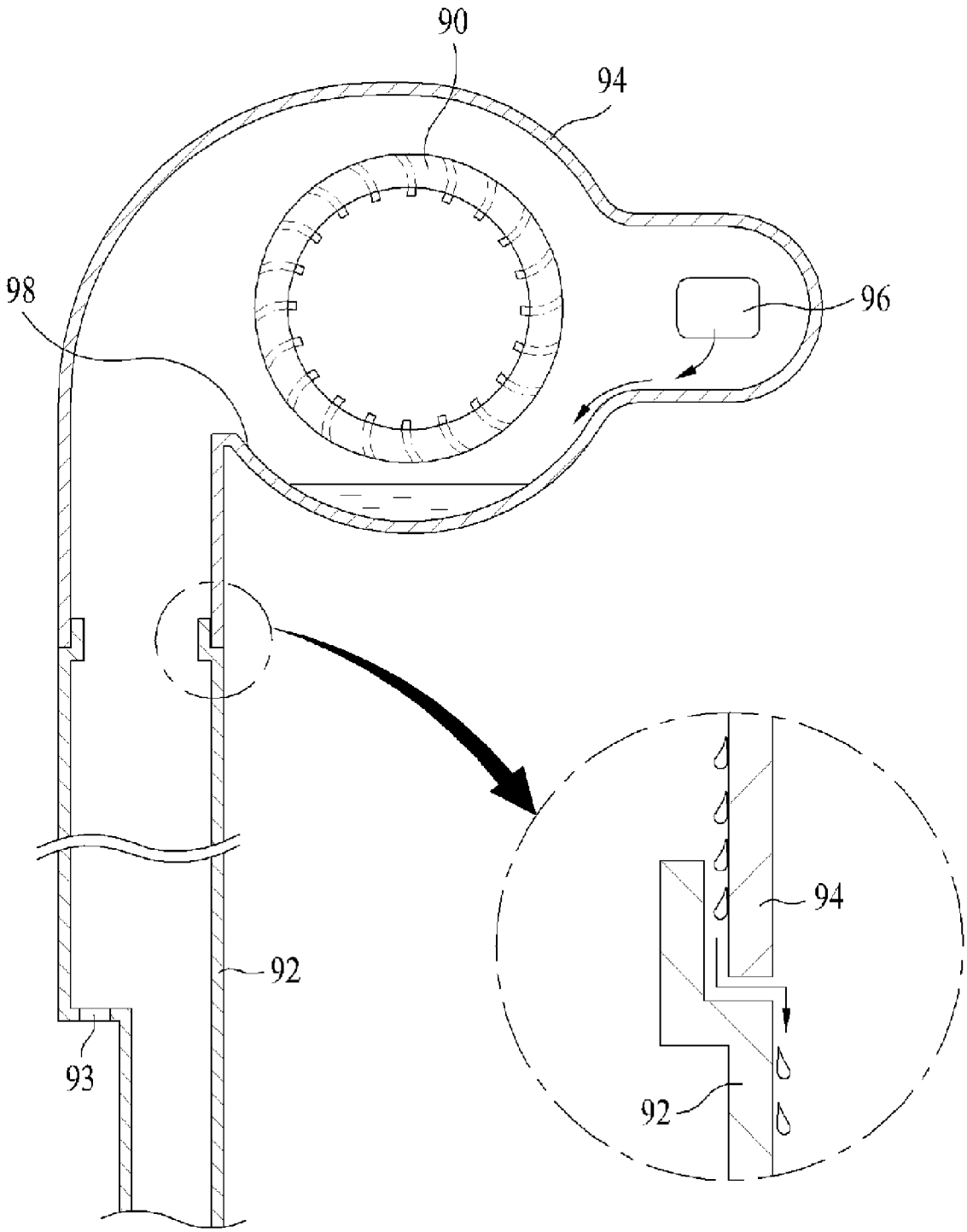

[Fig. 3]
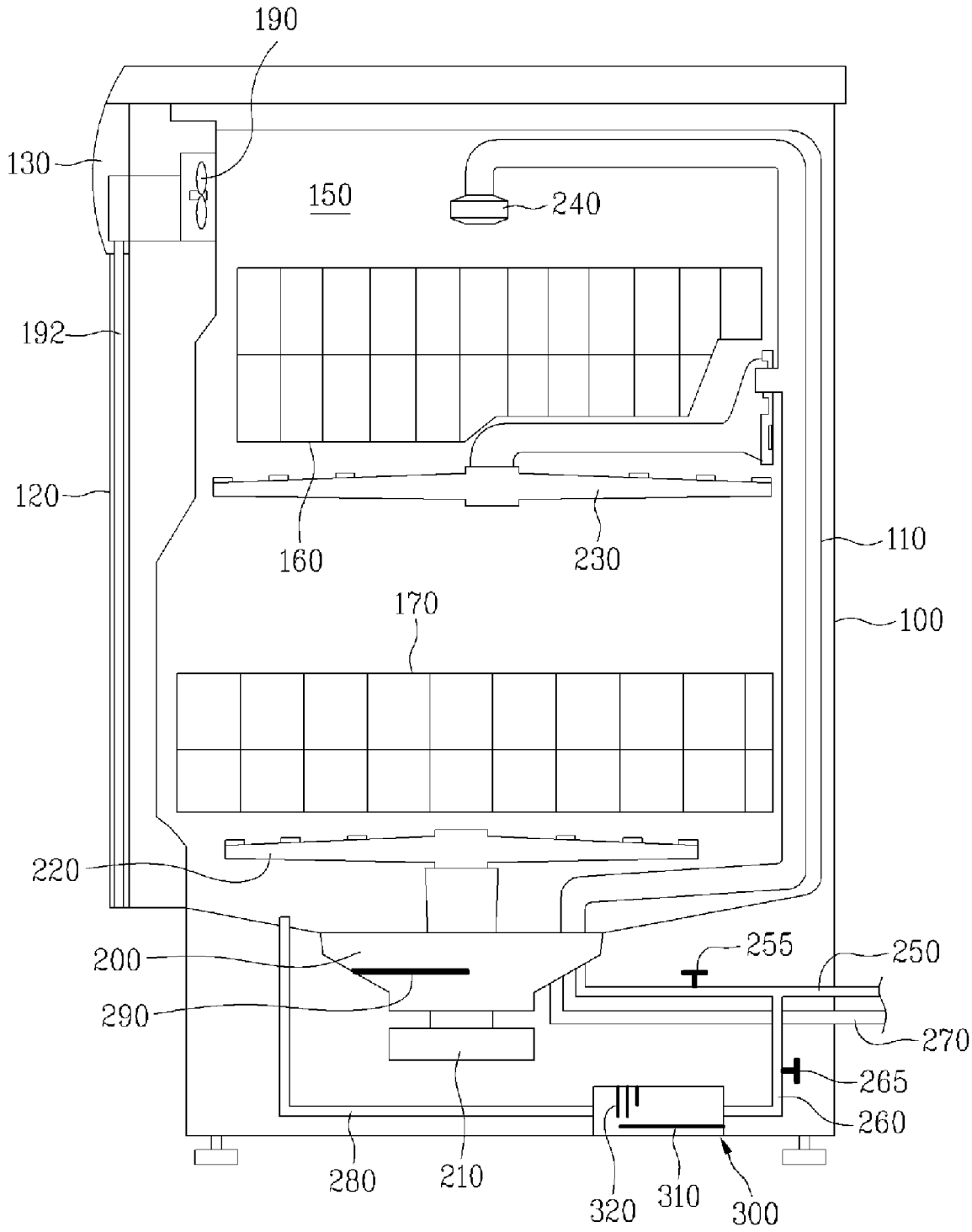

[Fig. 4]
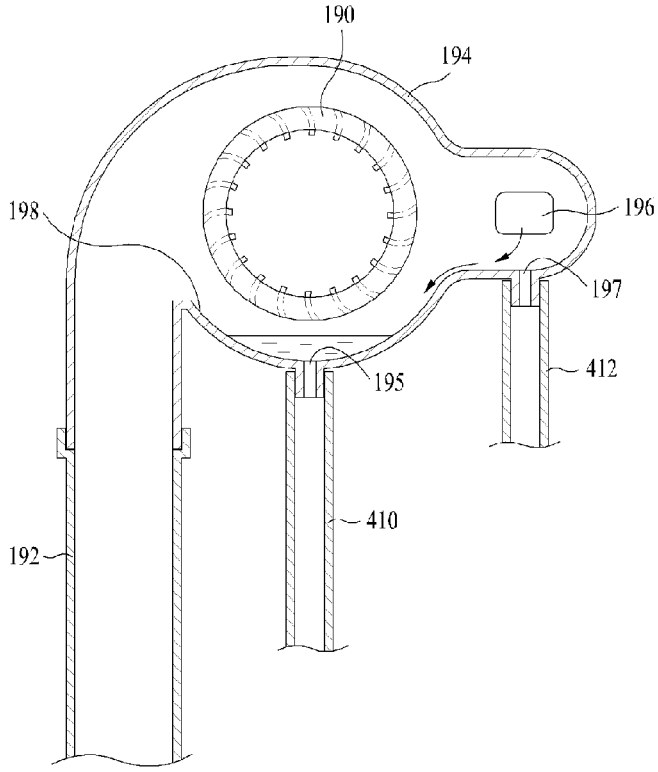
[Fig. 5]
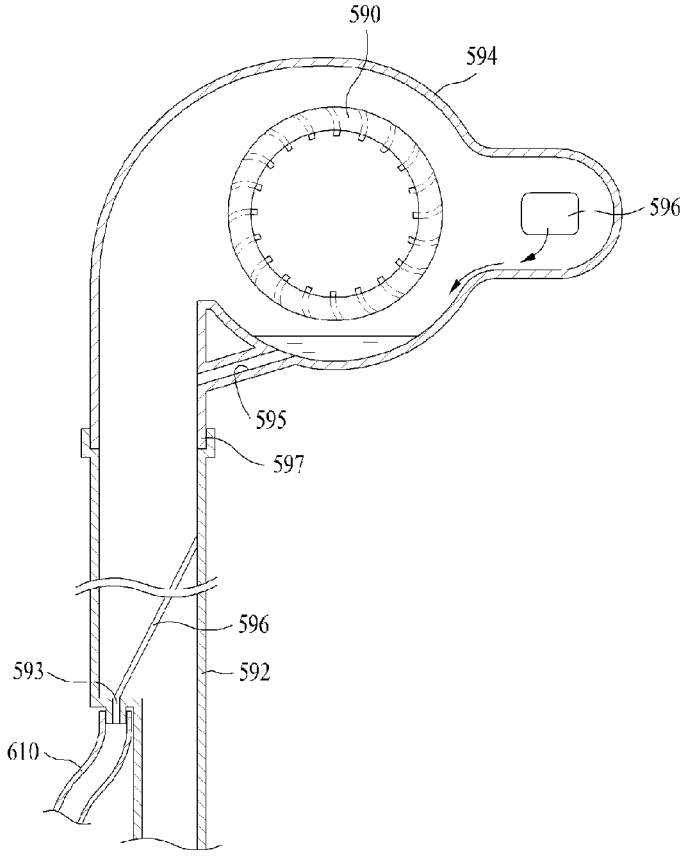

[Fig. 6]
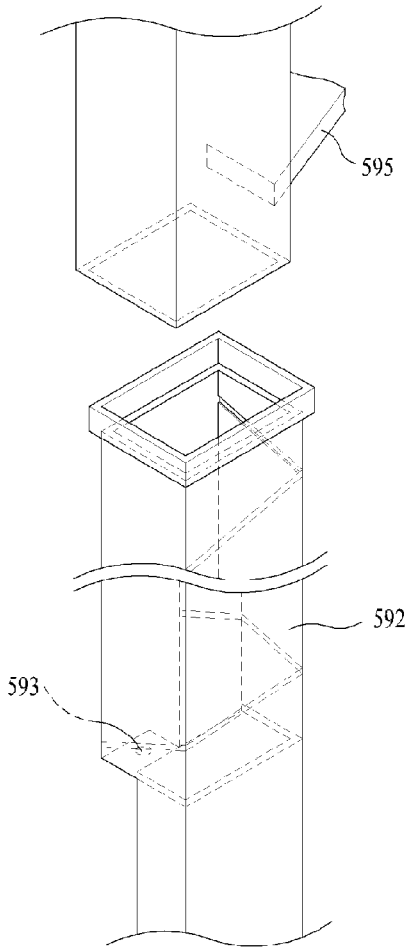
[Fig. 7]
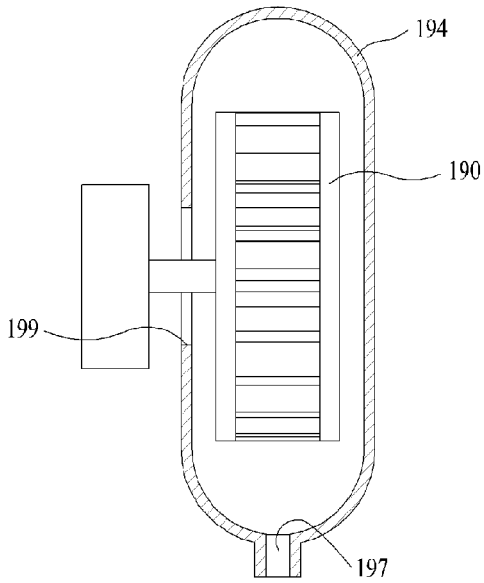

DISH WASHING MACHINE

TECHNICAL FIELD

The present invention relates to a dish washing machine, and more particularly to a dish washing machine having a structure in which a bottom surface of the dish washing machine is not wet with water.

BACKGROUND ART

In general, the dish washing machine automatically washes dishes by spraying washing water to the dishes placed in a washing chamber to remove foreign matters, such as food residue, from a surface of the dishes.

In general, the dish washing machine is operated by a washing step for spraying the washing water having detergent dissolved therein to the dishes to removed foreign matters from the dishes, a rinsing step for spraying the washing water only to remove foreign matters and detergent further after the washing, and a drying step for drying the dishes.

Recently, in order to enhance a washing effect further, dish washing machines are developed, in which the washing water is heated or steam is sprayed in the washing step or the rinsing step.

Referring to FIG. 1, a related art dish washing machine will be described.

The related art dish washing machine is provided with a case 100 which forms an exterior of the dish washing machine, and a door 120 for opening/closing the case 100.

In the case 100, there is a washing chamber 150 for holding and washing the dishes, and under the tub 110, there is a sump 200 for holding the washing water.

Mounted in the tub 110, i.e., in the washing chamber 150, there are at least one shelf and at least one spray arm for spraying water pumped up by the pump 210 to the at least one shelf.

The door 120 has a fan 90 and an exhaust duct 92 for discharging humid air from the washing chamber 150.

The exhaust duct 92 is extended to a lower side of the dish washing machine for guiding the air from the fan 90 to an outside of the dish washing machine.

FIG. 2 illustrates a section of the fan and a fan housing.

The fan 90 is housed in the housing 94. The housing 94 has the fan 90 housed therein, one side having an inlet 96 for drawing air from the washing chamber 150, and the other side having the exhaust duct 92 connected thereto. The housing 94 also has a spiral locus substantially for maximizing a fan 90 suction efficiency, and a cut-off portion 98 in the vicinity of a portion adjacent to the exhaust duct 92.

The exhaust duct 92 is extended to a lower end of the dish washing machine, and has a condensed water recovery passage 93 for returning condensed water from a predetermined portion of the exhaust duct to the washing chamber 150.

DISCLOSURE OF INVENTION

Technical Problem

However, the related art dish washing machine has the following problems.

In general, though there is damper (not shown) at the inlet 96 of the housing 94 for preventing the washing water from flowing into the housing, there is cases when the washing water flows into the housing due to poor water sealing of the damper. Moreover, it is liable that high temperature humid air introduced into the housing 94 from the washing chamber is condensed in the housing 94 to form condensed water.

Referring to FIG. 2, the water introduced into or formed in the housing 94 gathers on a bottom of the housing 94, i.e., at the cut-off portion 98. Since the water held at the portion does not disappear as far as the water is dried, the water can be a cause of bad smell.

Moreover, it is liable that the water held in a lower side of the housing 94 overflows or sprayed by the fan 90 to the exhaust duct 92.

If the water overflowing thus to the exhaust duct 92 is excessive, the water is not recovered through the condensed water recovery passage 93, but is discharged through an end of the exhaust duct 92, to wet the bottom of the dish washing machine.

In this case, if the condensed water recovery passage 93 is increased for recovering a large amount of water, loss of an exhaust air pressure caused by this portion is increased.

Moreover, referring to FIG. 2, since a circumferential edge of the exhaust duct 92 is placed inside of the housing 94, such that water flowing along an inside wall of the housing 94 leaks to an outside of the exhaust duct 92 through a gap between the exhaust duct 92 and the housing 94, an inside of the dish washing machine is liable to wet with the water.

Technical Solution

Accordingly, the present invention is directed to a dish washing machine.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dish washing machine includes a washing chamber for washing dishes, a fan for discharging air from the washing chamber, a housing for forming a space to install the fan, an exhaust duct for guiding the air from the housing to an outside of the dish washing machine, and a passage for draining water to an outside of the housing whenever the water is present in the housing.

The passage may be a first recovery passage for guiding the water from the housing to the washing chamber.

The first recovery passage may be in communication with a bottom of the housing.

A periphery of a portion of the housing in communication with the first recovery passage may be recessed such that water in the housing flows down and gathers.

In the meantime, the passage may include a drain passage for guiding water from the housing to the exhaust duct whenever water is introduced from the washing chamber to the housing or condensation of moisture is taken place in the housing, and a second recovery passage at the exhaust duct for recovering water flowing in the exhaust duct to the washing chamber.

The dish washing machine may further include a guide formed in the exhaust duct for guiding the water introduced to the exhaust duct through the drain passage to the second recovery passage.

Preferably, the guide is formed on an inside surface of the exhaust duct to have a step starting from a neighborhood of the drain passage to the second recovery passage.

The fan may be of a double suction type for drawing humid air from the washing chamber and external air together and discharging to the exhaust duct.

Moreover, an edge of the exhaust duct joined with the housing may surround an outside circumference of an edge of the housing which is joined with the exhaust duct.

In another aspect of the present invention, a dish washing machine includes a washing chamber for washing dishes, a fan for discharging air from the washing chamber, a housing for forming a space to install the fan, an exhaust duct for guiding the air from the housing to an outside of the dish washing machine, and a recovery passage provided separate from the exhaust duct and connected to the housing for guiding water from the housing to the washing chamber.

The housing has a cut-off portion on an inside surface and the recovery passage may be in communication with the housing at a location lower than a top of the cut-off portion.

Moreover, the recovery passage may be in communication with the housing below an inlet thereof through which humid air is drawn from the washing chamber.

It is to be understood that both the foregoing general description and the following detailed description of the present invention are exemplary and explanatory and are intended to provide further explanation of the invention as claimed.

Advantageous Effects

As has been described, the dish washing machine of the present invention has the following advantages.

First, since the water introduced from the washing chamber of the water condensed in the housing is recovered to the washing chamber through the first recovery passage, preventing the water from overflowing to the exhaust duct, wetting of the mounting surface of the dish washing machine is prevented.

Second, since, whenever the water is introduced to or formed therein, the water is drained to the exhaust duct along the drain passage without being held in the housing, recovering the water flowing in the exhaust duct to the washing chamber through the second drain hole and the second recovery passage entirely as a flow rate of the water introduced to the exhaust duct is not higher than capacity of the second drain hole and the second recovery passage, drain of the water from a lower side of the dish washing machine and wetting the mounting surface of the dish washing machine is prevented.

Third, because the edge of the exhaust duct joined to an underside of the outlet has an upward extension on the outside circumference of the outlet, the water flowing in the housing along the wall of the inside of the housing can not leak to an outside of the exhaust duct through a gap at the joining portion of the housing and the exhaust duct.

The present invention related to a dish washing machine having a structure in which water does not wet on a bottom surface of the dish washing machine is applicable to manufacturing of the dish washing machines.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a sectional view illustrating a related art dish washing machine.

FIG. 2 is a sectional view of the fan, the housing, and the exhaust duct in FIG. 1.

FIG. 3 is a sectional view illustrating a dish washing machine in accordance with a preferred embodiment of the present invention.

FIG. 4 is a sectional view of the housing and a portion of the exhaust duct of a dish washing machine in accordance with a preferred embodiment of the present invention.

FIG. 5 is a sectional view of the housing and a portion of the exhaust duct of a dish washing machine in accordance with another preferred embodiment of the present invention.

FIG. 6 is a perspective view of a portion of the exhaust duct in FIG. 5.

FIG. 7 is a sectional view of a housing in FIG. 5.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 3 is a sectional view illustrating a dish washing machine in accordance with a preferred embodiment of the present invention.

Referring to FIG. 3, the dish washing machine includes a case 100 which forms an exterior of the dish washing machine, a door 120 for opening/closing the case 100, and a control panel 130.

In the case 100, there is a washing chamber 150, and under the washing chamber 150, there is a sump 200 for holding washing water.

The sump 200 has a pump 210 for pumping the washing water and a filter (not shown) for filtering the washing water. The sump 200 may be provided with a sump heater 290 for heating the washing water.

The sump 200 has a first water supply pipe 250 connected thereto for receiving fresh water from water source, and a drain pipe 270 connected thereto for draining the washing water from the sump 200 to an outside of the dish washing machine. The water supply pipe 250 has a first water supply valve 255 mounted thereto for controlling water supply to the sump 200.

Mounted to an inside of the tub 110, i.e., in the washing chamber 150, there can be at least one shelf and at least one spray arm for spraying water pumped up by the pump 210 to the at least one shelf.

FIG. 3 illustrates an example in which an upper shelf 160 and a lower shelf 170 are arranged at a upper portion and a lower portion of the washing chamber respectively, and an upper spray arm 230 and a lower spray arm 220 for spraying water pumped by the pump 210 to the upper shelf 160 and a lower shelf 170, respectively.

In addition to this, there can be a top nozzle 240 mounted to a top side of the washing chamber 150 for spraying the water pumped by the pump 210 from the top side of the washing chamber 150 to a lower side of the washing chamber 150.

In the dish washing machine of the present invention, not only the washing water is sprayed in the washing chamber 150 by the pump 210 and the spray arms 230 and 220, but also steam is sprayed or supplied. To do this, the dish washing machine of the present invention may have a steam generator 300 provided separate from the sump heater 290 at the sump 210.

Referring to FIG. 3, the steam generator 300 is in communication with the first water supply pipe 250, and, through a steam supply pipe 280, with the washing chamber 150. The second water supply pipe 260 may have a second water supply valve 265 mounted thereto for controlling water supply to the steam generator 300.

The steam generator 300 includes a steam heater 310 for heating water in the steam generator 300, and a water level sensor 320 for sensing a water level of the steam generator 300. The water level sensor 320 may be provided to sense, for an example, a high water level and a low water level.

The low water level is set for protecting the steam heater 310 in the steam generator 300, and the high level is set for preventing the water supplied to the steam generator 300 from overflowing.

The steam generator may have a steam supply valve (not shown) for controlling opening/closing of the steam supply pipe 280 to supply the steam at a desired time.

The dish washing machine may have a turbidity sensor (not shown) for measuring turbidity of the washing water being washing the dishes. The turbidity sensor is mounted to one side of the sump for measuring the turbidity of the washing water circulating the inside of the tub.

A control unit (not shown) for controlling the dish washing machine is connected to electric operative units, such as the control panel 130, the pump 210, and the steam generator 300 for controlling operation of the dish washing machine.

Mounted to the top side of the washing chamber 150, there is elements required for discharging high temperature humid air from the washing chamber 150 which is heated with the steam and the washing water to an outside of the dish washing machine.

FIG. 4 illustrates a section of portions of elements required for discharging the air.

The elements required for discharging the air includes an exhaust fan 190 for drawing the high temperature humid air from the washing chamber 150, and a housing 194 for housing the exhaust fan 190, and an exhaust duct 192 for guiding the humid air drawn by the exhaust fan 190 to be discharged to an outside of the dish washing machine.

The exhaust duct 192 is connected to one side of the housing 194 such that the exhaust duct 192 is in communication with the housing 194, and is extended to a mounting surface of the dish washing machine through an inside of the door 120. The exhaust duct 192 may be extended such that a width thereof becomes the wider while a thickness thereof becomes the smaller.

In order to prevent water from dropping on the mounting surface of the dish washing machine from the housing 194 through the exhaust duct 192, a passage may be provided for draining the water from the housing 194 to an outside of the housing 194 every time the water is formed in the housing 194.

The water in the housing is the washing water introduced to the housing 194, or water condensed from the humid air drawn into the housing 194.

In the embodiment, the passage may be formed such that the water does not overflow from the housing 194 to the exhaust duct 192.

The passage may include a first recovery passage 410 in communication with the housing 194 for guiding water from the housing 194 to the washing chamber 150.

That is, the housing 194 has a first drain hole 195 in a bottom, and the first recovery passage 410 guides the water drained through the first drain hole 195 to the washing chamber 150.

The first recovery passage 410 has one end in communication with the first drain hole 195, and the other end in communication with the washing tub 150 for recovering the water from the first drain hole 195 to the washing chamber 150.

The first recovery passage 410 may be a tube or a duct, and may have a space for draining other water.

It is preferable that the first drain hole 195 is formed in a bottom surface of the housing 194 where the water in the housing gathers.

In general, it is preferable that the housing 194 has a spiral inside circumference for maximizing efficiency of the exhaust fan 190.

The housing 194 may have a cut-off portion 198 at a predetermined portion of the inside circumference, and a lowest point of the inside circumference of the housing 194 may be formed on a lower side of the cut-off portion 198.

Accordingly, it is preferable that the first drain hole 195 is formed in the lowest portion of the bottom surface of the housing 194.

Of course, a location of the first drain hole 195 is not limited to the lowest point of the housing 194, but may be other points. For an example, the first drain hole 195 may be formed below an inlet 196 through which the humid air of the washing chamber 150 is introduced to the housing 194. That is, by forming the first drain hole 197 and the first recovery passage 412 below the inlet 196, an effect can be expected in which the washing water introduced through the inlet 196 can be drained to the washing chamber 150, directly.

As described before, though the first drain hole 195 can be formed at a location, not limited to above example, but other than above example, preferably at a location lower than a top of the cut-off portion 198.

It is preferable that periphery of the first drain hole 195 of the housing 194 is recessed so that the water in the housing 194 can gather well.

This is for smooth flow down of, not only the washing water from the washing chamber 150, but also water condensed from humid air in the housing 194, along a wall surface of the housing 194 to the first drain hole 195.

Accordingly, since the first drain hole 195 is formed lower than the cut-off portion 198 in the housing 194, enabling to recover the water in the housing 194 to the washing chamber 150 along the first drain hole 195 and the first recovery passage 410 before the water overflows to the exhaust duct 192, overflowing of the water from the housing 194 to wet the mounting surface of the dish washing machine can be prevented.

Though the foregoing embodiment suggests an example in which the passage of the present invention includes the first drain hole 195 in the housing 194, and the first recovery passage 410 in communication with the first drain hole 195 and the washing chamber 150, an embodiment in which the passage is different from above example will be described.

The dish washing machine of the embodiment is similar to the foregoing embodiment in overall. However, of elements for exhaust, the passage is different from the foregoing embodiment. Therefore, only the passage will be described in description of the embodiment with reference to FIG. 5. Since parts other than the passage are identical to the foregoing embodiment, detailed description of the parts will be omitted.

The passage of the embodiment includes a drain passage 595 formed such that, whenever water is introduced from the washing chamber 150 to the housing 594, or condensed water is formed in the housing 594, the water flows down to the exhaust duct 592, a second drain hole 593 formed in the exhaust duct 592 so that water flowing in the exhaust duct 592 is drained to an outside of the exhaust duct 592, and a second recovery passage 610 for guiding the water drained through the second drain hole 593 to the washing chamber 150.

The drain passage 595 forms a space for the water to flow down, preferably from the housing 594 to the exhaust duct 592 with a slope downwardly. The drain passage 595 may be a separate tube, or a bottom surface of the housing 594 itself sloped downwardly to the exhaust duct 592.

In the meantime, the water flowing down from the housing 594 and the condensed water of the moisture in air flowing in the housing 594 can flow down along an inside wall of the exhaust duct 592. The exhaust duct 592 may have a second drain hole formed so that the water in the exhaust duct 592 does not drop on the mounting surface of the dish washing machine through an edge of the exhaust duct 592. The second drain hole 593 may be formed in one side of the exhaust duct 592, preferably at a location the water in the exhaust duct 592 passes therethrough.

A second recovery passage 610 is further provided for guiding the water from the second drain hole 593 to the washing chamber 150.

Accordingly, the water flowing in the exhaust duct 592 is recovered to the washing chamber 150 through the second drain hole 593 and the second recovery passage 610, again.

A guide 596 may further be formed for guiding the water introduced to the exhaust duct 592 through the second recovery passage 610 to the second drain hole 593.

FIG. 6 illustrates a diagram of a guide on an inside surface of the exhaust duct.

Referring to FIG. 6, it is preferable that the guide 596 is formed on the inside surface of the exhaust duct 592 starting from a lower end of a point where the second recovery passage 610 and the exhaust duct 592 are in communication to a top side of the second drain hole 593. The guide may be formed to have a step with the inside surface of the exhaust duct 592, such as a groove in the inside surface of the exhaust duct 592, so that the water introduced to the exhaust duct 592 through the second recovery passage flows along the guide 596 down to an upper side of the second drain hole 593.

In the embodiment, since, whenever the water is introduced to or formed therein, the water is drained to the exhaust duct 592 along the drain passage 595 without being held in the housing 594, recovering the water flowing in the exhaust duct 592 to the washing chamber 150 through the second drain hole 593 and the second recovery passage 610 entirely as a flow rate of the water introduced to the exhaust duct is not higher than capacity of the second drain hole 593 and the second recovery passage 610, drain of the water from the end of the exhaust duct 592 is prevented. Moreover, since a case in which a large amount of water flows at a time is prevented because water is not held in the housing 594, requiring no enlargement of the second drain hole 593, an exhaust loss caused by the second drain hole 593 can be minimized.

Moreover, offensive odor or breeding of microbe which is liable to be caused by water held in the housing 594 can be prevented.

In the meantime, at the time a high temperature humid air is discharged from the washing chamber, it is possible to lower the temperature and humidity of the air by drawing external air to condense the moisture.

FIG. 7 is a sectional view of a housing of the dish washing machine of the present invention.

For this, it is preferable that the exhaust fan 190 is of a double suction type, and the housing 194 also has a separate pass through hole 199 in addition to the inlet 196 (see FIG. 4) which is to draw the humid air from the washing chamber 150 for drawing in external air.

Therefore, once the exhaust fan 190 is put into operation, since the high temperature humid air is drawn from the washing chamber to the housing 194 through the inlet 196, and external low temperature air is drawn through the pass through hole 199, and the high temperature humid air and the external low temperature air is mixed in the exhaust duct 192 (see FIG. 4), dropping a temperature of air flowing in the exhaust duct 192 to drop humidity of the air as condensation of the moisture is taken place, an air temperature of the air discharged from the dish washing machine can also be dropped.

The condensed water formed in the exhaust duct 192 can be recovered to the washing chamber through the second drain hole 593 (see FIG. 5) and the second recovery passage 610 (see FIG. 5).

In the meantime, the present invention suggests a joining structure for joining the housing and the exhaust duct for preventing water from leaking between the joining portion of the housing and the exhaust duct.

FIG. 5 illustrates an improved joining structure for joining the housing and the exhaust duct.

In the present invention, the joining structure will be described, taking an embodiment in which an exhaust duct is mounted to an under side of the housing as shown in FIG. 5.

The housing 594 has an outlet 597 formed to face downward for discharging air the fan drawn, and the exhaust duct 592 is joined to the outlet 597.

In this instance, it is preferable that edges of the housing and the exhaust duct 597 overlap for a predetermined portions, such that the edge of the exhaust duct 592 which overlaps with the edge of the outlet of the housing 594 surrounds an outside circumference of the outlet 597 of the housing 594.

That is, because the edge of the exhaust duct 592 joined to an underside of the outlet 597 has an upward extension on the outside circumference of the outlet 597, the water flowing in the housing 594 along the wall of the inside of the housing 594 can not leak to an outside of the exhaust duct 592 through a gap at the joining portion of the housing 594 and the exhaust duct 592.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A dish washing machine comprising:

a washing chamber washing dishes;

a fan discharging air from the washing chamber;

a housing forming a space to install the fan;

an exhaust duct guiding the air from the housing to an outside of the dish washing machine; and a passage draining water to an outside of the housing whenever the water is present in the housing, wherein the passage includes a drain passage for guiding water from the housing to the exhaust duct whenever water is introduced from the washing chamber to the housing or condensation of moisture is taken place in the housing, and a second recovery passage at the exhaust duct for recovering water flowing in the exhaust duct to the washing chamber.

2. The dish washing machine as claimed in claim 1, further comprising a guide formed in the exhaust duct for guiding the water introduced to the exhaust duct through the drain passage to the second recovery passage.

3. The dish washing machine as claimed in claim 2, wherein the guide is formed on an inside surface of the exhaust duct to have a step starting from a neighborhood of the drain passage to the second recovery passage.

4. The dish washing machine as claimed in claim 1, wherein the fan is of a double suction type for drawing humid air from the washing chamber and external air together and discharging to the exhaust duct.

5. The dish washing machine as claimed in claim 1, wherein an edge of the exhaust duct joined with the housing surrounds an outside circumference of an edge of the housing which is joined with the exhaust duct.

* * * * *